US007422349B2

(12) United States Patent
Wada et al.

(10) Patent No.: US 7,422,349 B2
(45) Date of Patent: Sep. 9, 2008

(54) LED LIGHTING APPARATUS

(75) Inventors: Satoshi Wada, Aichi-ken (JP); Yoshinobu Suehiro, Aichi-ken (JP)

(73) Assignee: Toyoda Gosei Co., Ltd., Nishikasugai-gun (JP)

( * ) Notice: Subject to any disclaimer, the term of this patent is extended or adjusted under 35 U.S.C. 154(b) by 0 days.

(21) Appl. No.: 11/411,144

(22) Filed: Apr. 26, 2006

(65) Prior Publication Data

US 2006/0245201 A1 Nov. 2, 2006

(30) Foreign Application Priority Data

Apr. 28, 2005 (JP) ..... 2005-133751

(51) Int. Cl.
*F21V 29/00* (2006.01)

(52) U.S. Cl. ..... 362/373; 362/241; 362/294

(58) Field of Classification Search ..... 362/84, 362/231, 240, 241, 294, 345, 373, 545, 800; 257/98, 99, 100; 361/717, 718, 719
See application file for complete search history.

(56) References Cited

U.S. PATENT DOCUMENTS

| | | | | |
|---|---|---|---|---|
| 5,174,646 | A * | 12/1992 | Siminovitch et al. | 362/373 |
| 6,439,888 | B1 * | 8/2002 | Boutoussov et al. | 433/215 |
| 6,578,998 | B2 * | 6/2003 | Zhang | 362/294 |
| 7,083,304 | B2 * | 8/2006 | Rhoads et al. | 362/294 |
| 7,246,917 | B2 * | 7/2007 | Rhoads et al. | 362/241 |
| 2005/0168994 | A1 * | 8/2005 | Jacobson et al. | 362/294 |
| 2006/0231737 | A1 * | 10/2006 | Matsumoto et al. | 250/208.1 |

FOREIGN PATENT DOCUMENTS

JP 5-38927 5/1993

* cited by examiner

*Primary Examiner*—Y M. Lee
(74) *Attorney, Agent, or Firm*—McGinn IP Law Group, PLLC

(57) ABSTRACT

An LED lighting apparatus has a plurality of reflection-type LED lamps. The lamps each have an LED, a reflector portion to reflect a light emitted from the LED, and a case portion having a radiation fin that is formed along a vertical section of the case portion to pass through a center of the case portion. The LED is mounted on an end of the radiation fin.

20 Claims, 12 Drawing Sheets

LED LIGHTING APPARATUS

The present application is based on Japanese patent application No. 2005-133751, the entire contents of which are incorporated herein by reference.

BACKGROUND OF THE INVENTION

1. Field of the Invention

This invention relates to an LED lighting apparatus using an LED (light emitting diode) element as a light source and, in particular, to an LED lighting apparatus that has a high reliability and is downsized as well as having a good heat radiation property corresponding to implementation of a high-output and high-light intensity LED.

2. Description of the Related Art

A lighting apparatus using an LED element as a light source is known. In such a lighting apparatus, light emitted from the LED element can be efficiently directed to a desired radiation direction by providing the LED-mounted substrate or a member disposed around it with a light-reflecting property.

In recent years, a white LED lighting apparatus with a good mass productivity and a long-term reliability is demanded. Especially, it is desired to use the white LED lighting apparatus as a vehicle lighting apparatus such as a headlight. Necessary requirements for the headlight are to have a light-focusing property and light diffusion property enough to direct a white light to a desired radiation range as well as to have a high-light intensity.

It is known to drive a large-size LED element by feeding a large current in order to have a high-intensity white light. However, due to heat generated according to the amount of current fed, emission efficiency of the LED element may be reduced. Furthermore, the light intensity may be reduced by light deterioration of sealing resin such as an epoxy resin and silicone resin to seal the LED element.

To solve these problems, JP Utility-Model Application Laid-Open No. 5-38927 (hereinafter referred to as JP 5-38927) discloses a reflection-type lighting apparatus that a light emitted from an LED element is reflected by a reflector disposed opposed to the LED element, and a lead portion to feed power to the LED element is disposed midway in the traveling direction of light reflected by the reflector without affecting the light extraction property while offering a good heat radiation property.

JP 5-38927 teaches that the lead portion is formed to have a width projected in a direction perpendicular to the traveling direction of the reflected light greater than the width of the LED element and smaller than its width in a direction parallel to the reflected light, and, therefore, the heat radiation property can be improved while suppressing the shading affection of the lead portion constant (See paragraphs [0008] to [0009] and FIG. 1 of JP 5-38927).

However, the lighting apparatus of JP 5-38927 has the following problems.

(1) Since the reflector and the lead portion are integrally sealed with an epoxy resin, the light extraction property may be reduced by the light deterioration of the epoxy resin due to a large amount of heat generated from the LED element caused by an increase in light intensity of the LED element. Thus, the lighting apparatus cannot secure a long-term reliability.

(2) Since heat generated from the LED element is radiated through the lead portion, the lead portion needs to have a radiation area increased according to the heat generation in order to radiate efficiently the increased heat. This causes an increase in apparatus size.

SUMMARY OF THE INVENTION

It is an object of the invention to provide an LED lighting apparatus that can have a high reliability and can be downsized as well as having a good heat radiation property corresponding to implementation of a high-output and high-light intensity LED.

(1) According to the invention, an LED lighting apparatus comprises:

a plurality of reflection-type LED lamps each comprising an LED, a reflector portion to reflect a light emitted from the LED, and a case portion comprising a radiation fin that is formed along a vertical section of the case portion to pass through a center of the case portion, wherein the LED is mounted on an end of the radiation fin.

In the above invention (1), the following modifications and changes can be made.

(i) The LED comprises a glass-sealed LED that an LED element and a phosphor are sealed with a glass, wherein the phosphor is capable of being excited by the light emitted from the LED element.

(ii) The plurality of reflection-type LED lamps each comprises the case portion and the radiation fin which comprise a size corresponding to an illuminating range of each of the LED lamps.

(iii) The plurality of reflection-type LED lamps each comprises a reflector surface which comprises a size corresponding to an illuminating range of each of the LED lamps.

(iv) The reflector surface comprises a mirror shape formed by combining a part of an oval shape.

(v) The plurality of reflection-type LED lamps each comprises a plurality of reflection-type LED lamps that comprise a same illuminating rage and a same size.

(vi) A plurality of the LED's are arrayed in the one case portion.

(vii) The radiation fin comprises a positioning portion for positioning the LED at a predetermined position.

(viii) The case portion comprises a lens portion that seals a part on a light extraction side of the case portion while keeping a part of the radiation fin exposed.

BRIEF DESCRIPTION OF THE DRAWINGS

The preferred embodiments according to the invention will be explained below referring to the drawings, wherein:

FIG. 3A is a cross sectional view cut along a line C-C in FIG. 2, FIG. 3B is a cross sectional view cut along a line B-B in FIG. 2, and FIG. 3C is a cross sectional view cut along a line A-A in FIG. 2;

FIG. 11A shows a reflection-type array with a lamp unit with a lamp portion arrayed linearly, and FIG. 11B shows a reflection-type array with a lamp unit with a lamp portion arrayed like a pyramid;

FIG. 12A shows a first board-positioning structure to a radiation fin, and FIG. 12B shows a second board-positioning structure to a radiation fin.

DETAILED DESCRIPTION OF THE PREFERRED EMBODIMENTS

First Embodiment

Figure 1:
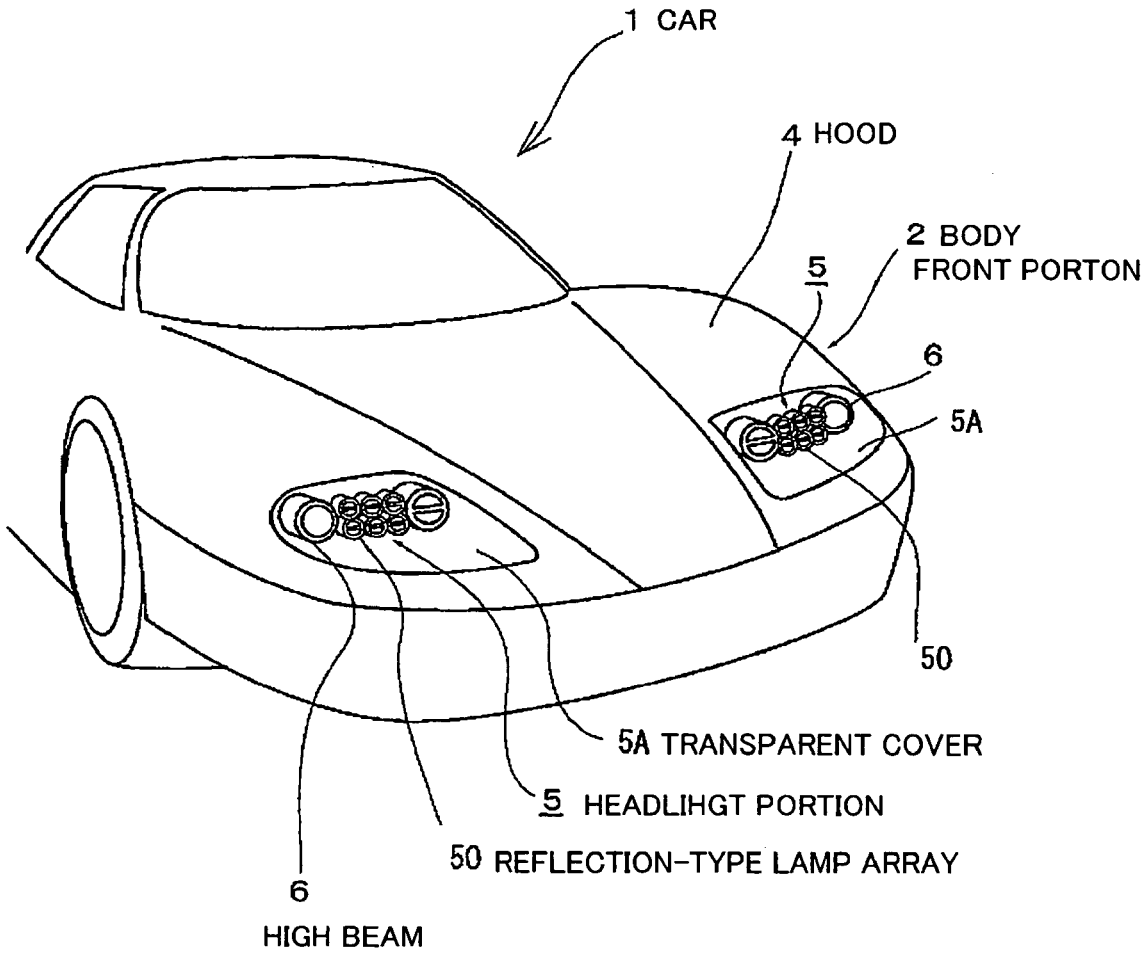
FIG. 1 is a perspective view showing a part of a car equipped with a headlight as an LED lighting apparatus in a first preferred embodiment according to the invention.
Figure 2:
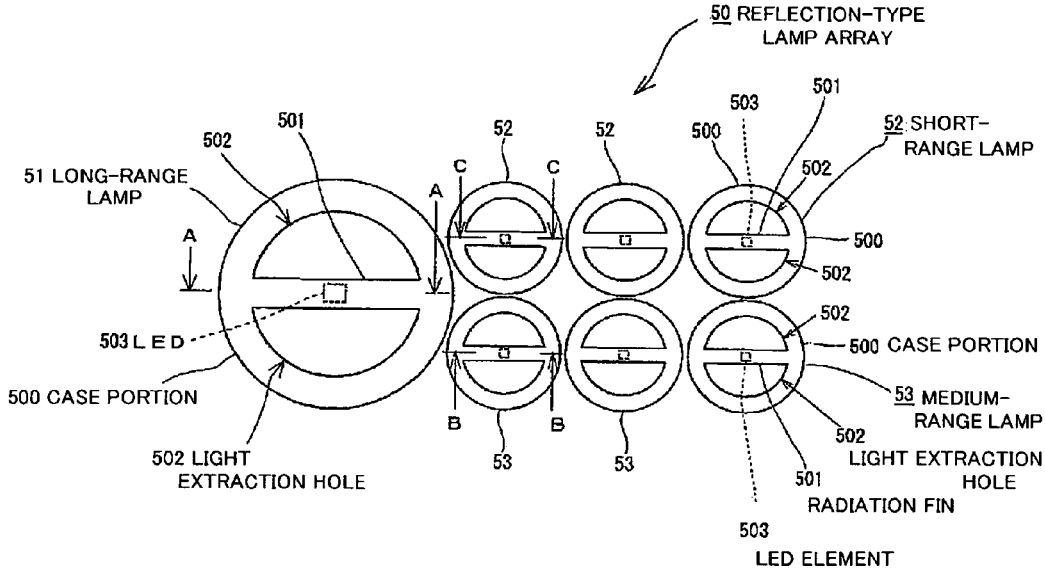
FIG. 2 is a front view showing the headlight in FIG. 1.
Figure 3A:
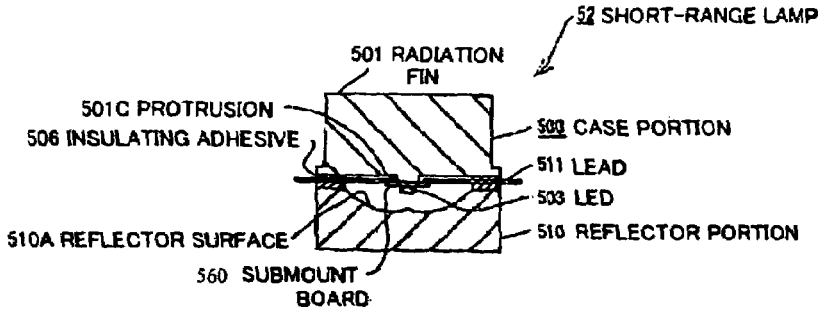
FIGS. 3A to 3C show short-range, medium-range and long-range reflection-type lamps, respectively, to compose the headlight as shown in FIG. 2, where
Figure 3B:
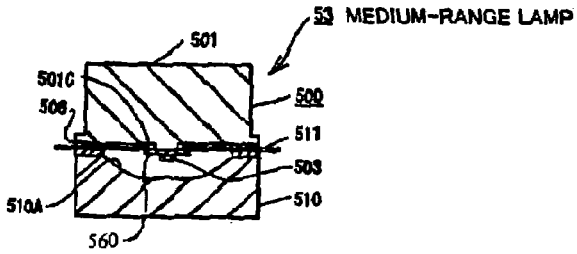
Figure 3C:
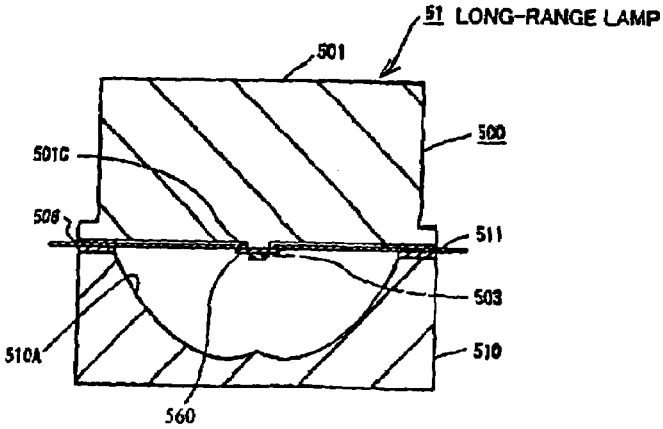
Figure 4:
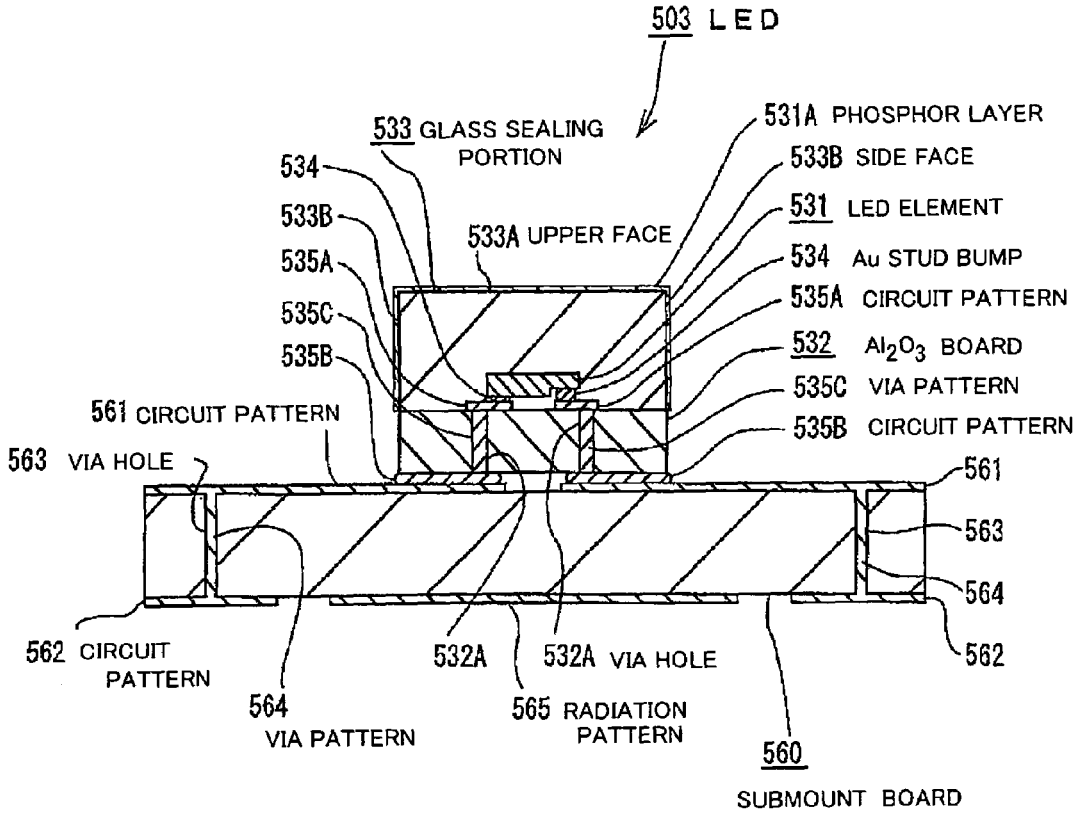
FIG. 4 is a cross sectional view showing an LED as a light source of the lamps and a submount board.

FIG. 1 is a perspective view showing a part of a car equipped with a headlight as an LED lighting apparatus in the first preferred embodiment according to the invention. FIG. 2 is a front view showing the headlight in FIG. 1. FIGS. 3A to 3C show short-range, medium-range and long-range reflection-type lamps, respectively, to compose the headlight as shown in FIG. 2, where FIG. 3A is a cross sectional view cut along a line C-C in FIG. 2, FIG. 3B is a cross sectional view cut along a line B-B in FIG. 2, and FIG. 3C is a cross sectional view cut along a line A-A in FIG. 2. FIG. 4 is a cross sectional view showing an LED as a light source of the lamps and a submount board.

The car 1 comprises a hood 4 which is provided at a front portion 2 of the car while being allowed to open and close, and a headlight portion 5 composed of: a reflection-type lamp array 50 which is provided on or near the hood 4 and is composed of plural reflection-type lamps with different illuminating ranges; and a high beam 6 which is provided outside of the reflection-type lamp array 50. The headlight portion 5 is provided, on its front side, with a transparent cover 5A with a light transmitting property.

Construction of the Reflection-type Lamp Array 50

As shown in FIG. 2, the reflection-type lamp array 50 composes a low beam by a combination of a long-range lamp 51, a short-range lamp 52, and a medium-range lamp 53. The reflection-type lamp array 50 comprises one long-range lamp 51, three short-range lamps 52, and three medium-range lamps 53. The short-range lamp 52 and the medium-range lamp 53 are each arrayed at certain intervals in the horizontal direction.

With respect to the long-range lamp 51, the short-range lamp 52 and the medium-range lamp 53, the respective lamps to compose the reflection-type lamp array 50 have a similar construction except its light reflecting portion. Thus, for example, the construction the long-range lamp 51 will be described below.

As shown in FIGS. 2 and 3C, the long-range lamp 51 comprises: a cylindrical case portion 500 which is formed by being forged from aluminum; a radiation fin 501 which has a predetermined thickness and is formed along its vertical section to pass through the center of the case portion 500; an LED 503 which is attached through a submount board 560 onto the bottom of the radiation fin 501 and emits white light; a reflector portion 510 which is formed of aluminum to be integrated with the case portion 500 and which comprises a reflector surface 510A formed of aluminum to reflect light emitted from the LED 503; and a lead 511 which is formed of a copper alloy to feed power to the LED 503. The radiation fin 501 is provided with a protrusion 501C where the submount board 560 is attached to.

The case portion 500 may be formed of the other material than aluminum, e.g., a copper alloy. Further, it may be formed by casting or pressing other than the forging.

The power feeding to the LED 503 can be also made by using a flexible wiring that a conductive material layer such as a copper foil is coated by an insulating material such as polyimide, instead of using the lead 511.

The reflector portion 510 may be formed of the other material than the metallic material, e.g., a resin material with a heat resistance. Further, it can be formed of a thin plate with the reflector surface 510A and can be formed by pressing an aluminum material with a high linear reflectivity.

The reflector portion 510 may be composed of a metallic radiation case and a resin reflector built in the radiation case. When the reflector is made of a resin, the productivity can be enhanced to reduce the cost and weight. Also, the reflector can be easy designed, e.g., changed in shape, according to a desired optical characteristic.

Construction of the Long-range Lamp 51

The case portion 500 has a light extraction hole 502 to serve to extract externally light emitted from the LED 503 and then reflected on the reflector surface 510A. The case portion 500 of the long-range lamp 51 has an outer diameter of 40 mm.

The radiation fin 501 is formed to have a size according to the length of the case portion 500 in forging the case portion 500. It can rapidly transfer a heat generated during the operation of the LED 503 to the case portion 500 while receiving the heat through the submount board 560. In this embodiment, the radiation fin 501 of the long-range lamp 51 has a thickness of 4 mm. However, it is preferred that the thickness is suitably set to have an optimum value according to the heat release value of the lamp.

The LED 503 is a glass-sealed LED that an LED element is sealed with a glass which is excellent in glass sealing property and light degradation resistance for the LED element. It is electrically connected through the submount board 560 to the lead 511.

The reflector surface 510A is formed into a mirror shape by combining a part of an oval shape, whereby light emitted from the LED 503 can be reflected thereon to be radiated in a desired illuminating range.

Construction of the Short-range Lamp 52 and the Medium-Range Lamp 53

The short-range lamp 52 and the medium-range lamp 53 are different in the shape of the reflector surface 510A. The reflector surface 510A of the medium-range lamp 53 is provided with a mirror area greater than that of the short-range lamp 52 to enhance the focusing property of light emitted from the LED 503. The short-range lamp 52 and the medium-range lamp 53 are 20 mm in the outer diameter of the case portion 500 and 2 mm in the thickness of the radiation fin 501.

Construction of the LED 503

The LED 503 comprises: a flip-chip type LED element 531 of GaN-based semiconductor; an $Al_2O_3$ board 532 as an inorganic board on which the LED element 531 is mounted; a glass sealing portion 533 as an inorganic sealing material; an Au stud bump 534 which connects electrically electrodes of the LED element 531 with a circuit pattern 535A (of tungsten (W)) formed on a mount surface of the $Al_2O_3$ board 532; and a phosphor layer 531A which is a thin film formed on the surface of the glass sealing portion 533, where the phosphor layer 531A contains a phosphor, a Ce (cerium)-doped YAG (yttrium aluminum garnet) which is excited by a blue light emitted from the light-emitting layer to radiate a yellow light. The phosphor layer 531A is formed by coating a phosphor solution with the YAG mixed therein with a binder on the surface of the glass sealing portion 533 and then drying it. The LED element 531 has a thermal expansion coefficient of $7\times10^{-6}/°$ C.

The $Al_2O_3$ board 532 has a via hole 532A in its section, and the circuit pattern 535A on the mount surface is electrically connected thorough a via pattern 535C (of W) formed in the via hole 532A to a circuit pattern 535B on the back of the $Al_2O_3$ board 532. The $Al_2O_3$ board 532 has a thermal expansion coefficient of $7\times10^{-6}/°$ C.

The glass sealing portion 533 is formed of a $SiO_2$—$Nb_2O_5$-based low-melting glass (with a refractive index of n=1.8) and is provided with a flat upper face 533A and a flat side face 533B. The glass sealing portion 533 has a thermal expansion coefficient of $7\times10^{-6}/°$ C.

The LED element 531 comprises an AlN buffer layer, an n-GaN layer, the light-emitting layer, and a p-GaN layer which are sequentially grown on an underlying substrate, sapphire substrate. Further, it comprises an n-side electrode which is formed on the n-GaN layer exposed by removing a part of the p-GaN layer through the n-GaN layer by etching, and a p-side contact electrode which is formed on the surface of the p-GaN layer and serves as a current spreading layer and a light reflecting layer.

The LED element 531 can be fabricated optionally by known metalorganic chemical vapor deposition (MOCVD), molecular beam epitaxy (MBE), hydride vapor phase epitaxy (HVPE), sputtering, ion plating, electron shower etc. The LED element 531 may comprise a homo-, hetero- or double-hetero-structure. Further, it may comprise a quantum well structure (single quantum well or multiquantum well structure).

The submount board 560 is formed of AlN with an excellent heat radiation property. The submount board 560 comprises: a circuit pattern 561 which is electrically connected through a solder etc. to the circuit pattern 535B of the LED 503; a circuit pattern 562 which is formed on the opposite face to the LED mount surface of the submount board 560; a via pattern 564 which is formed in a via hole 563 provided between the surface and the back surface of the submount board 560 to connect electrically the circuit patterns 561 and 562; and a radiation pattern 565 which is solder-bonded to the radiation fin 501. The submount board 560 can be formed of the other insulating material than the AlN, and it is preferably formed of a material which has an excellent heat radiation property for the heat generated during the operation of the LED 503.

Process of Making the Long-range Lamp 51

In making the long-range lamp 51, at first, in a separate step, the LED 503 is mounted on the submount board 560 and the lead 511 is connected to the submount board 560.

Then, the case portion 500 is manufactured such that the radiation fin 501 is formed in the cylindrical section by forging aluminum.

Then, in a separate step, the reflector portion 510 with the reflector surface 510A is formed by forging aluminum and the reflector surface 510A is mirror-finished to enhance the light reflecting property.

Then, the submount board 560 with the lead 511 connected thereto is attached to the protrusion 501C of the radiation fin 501. The submount board 560 is attached by solder-bonding the radiation pattern 565.

Then, the case portion 500 is bonded to the reflector portion 510 through an insulating adhesive 506 so as not to short-circuit the lead 511 with the case portion 500 and the reflector portion 510, while laying a bonding plane on the bottom side of the mounted LED 503.

Operation of the Headlight Portion 5

When a driver operates a switch to turn on the low beam, a voltage is applied from a power supply circuit (not shown) to the lead 511 of the short-range lamp 52 and the medium-range lamp 53. Thereby, the LED element 531 of the LED 503 emits a blue light. The blue light is irradiated to the phosphor layer 531A on the glass sealing portion 533, exciting the phosphor to radiate a yellow light, whereby a white light is generated by the combination of the blue light and the yellow light. The white light is reflected by the reflector portion 510 almost to a direction where the radiation fin 501 is formed, then radiated through the light extraction hole 502 outside the case portion 500.

Figure 5:
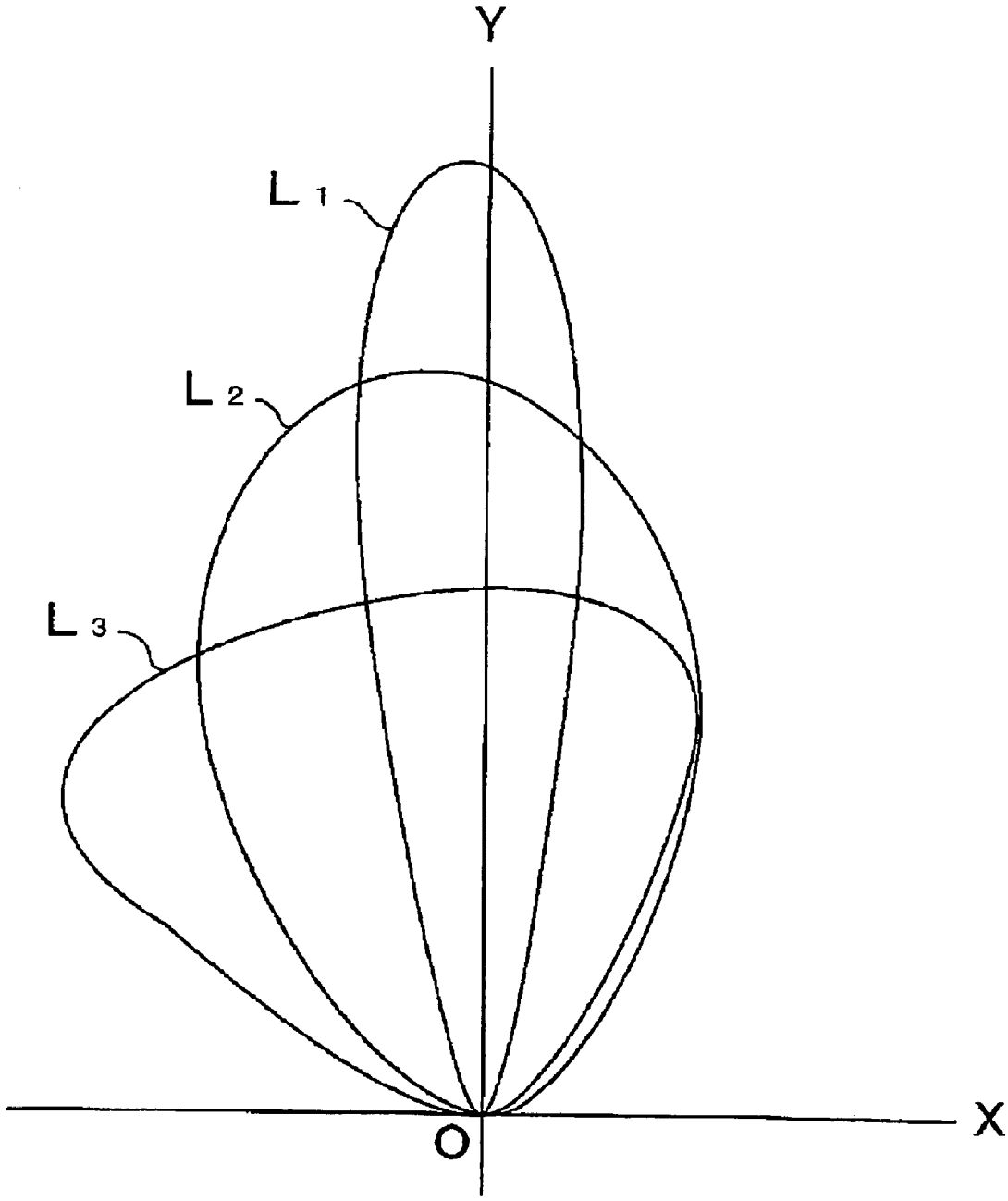
FIG. 5 is a diagram showing a low-beam light distribution in the first embodiment.

FIG. 5 is a diagram showing a low-beam light distribution in the first embodiment. In FIG. 5, 0 is a foremost part of the car 1, and the reason why the illuminated light is distributed more in −X direction is to prevent the driver of the oncoming car in the left-hand traffic from being dazzled. $L_1$ is a light distribution property of the long-range lamp 51, where white light is radiated in the long-distance range based on the shape of the case portion 500 and the reflector surface 510A. $L_2$ is a light distribution property of the medium-range lamp 53, where white light is radiated in the middle-distance range by using the three medium-range lamps 53 with a smaller size than the long-range lamp 51. $L_3$ is a light distribution property of the short-range lamp 52, where white light is radiated in the short-distance range by using the three short-range lamps 52 with the reflector surface 510A smaller than the medium-range lamp 53 though having the same size as the medium-range lamp 53.

The light distribution can be changed by the switching operation of the driver. When the driver operates the switch to turn on the high beam, the high beam 6 of the headlight portion 5 as shown in FIG. 1 turns on. The high beam 6 is, for example, a halogen lamp provided with a focusing lens on its front side. On the other hand, when the driver selects the low beam, the long-range lamp 51, the three medium-range lamps 53 and the three short-range lamps 52 turn on.

Effects of the First Embodiment (1) Since the plural reflection-type lamps with the different light distribution properties are combined to compose the reflection-type lamp array 50, the headlight can be downsized with an excellent heat radiation property. Further, it can easy offer a high brightness as well as a desired light distribution property while preventing an optical loss such as total reflection and light absorption to be caused in a resin-sealed lamp.

(2) Although white light radiated from the LED 503 is reflected by the reflector surface 510A to be extracted outside the case portion 500, the light can be extracted without being blocked by the LED 503 and the radiation fin 501. Thus, the headlight can offer an excellent heat conduction property and heat radiation property by disposing the highly heat-conductive material near the heat source.

(3) The headlight portion 5 is formed with the reflection-type lamp array 50 for the low beam which is composed of the long-range lamp 51, the short-range lamp 52 and the medium-range lamp 53 with the different light distribution properties. Therefore, the light arrangement can be flexibly made according to the design of the car.

(4) Since the LED 503 as a light source is composed of the glass-sealed LED element 531, the light deterioration of the sealing material is prevented so that an LED lighting apparatus can have a high reliability to keep the light intensity over a long period. Further, the interior of the case portion 500 and the reflector portion 510 need not to be sealed with a light-transmitting material. Therefore, the manufacturing process is not complicated, and it is thus excellent in mass productivity.

In the first embodiment, the headlight portion 5 uses, as a light source, the wavelength conversion type LED 503 to generate the white light by mixing the blue light and the yellow light. However, the headlight portion 5 may be composed of R, G and B LED elements mounted on the submount board 560 such that white light is generated by mixing lights emitted from the respective LED elements. Alternatively, an LED element to emit ultraviolet light may be used instead of the LED element to emit blue light, and R, G and B phosphors to be excited by the ultraviolet light to radiate R, G and B lights, respectively, may be used together. Thus, a wavelength conversion type light source can emit white light by mixing the R, G and B lights.

Alternatively, another light source can be composed such that an LED element of a GaN-based semiconductor material to emit blue light is flip-chip mounted on the submount board 560, and the LED element is sealed with a yellow phosphor-containing resin such as YAG.

With respect to the light distribution property of each of the lamps, the illuminating range can be changed by shifting the LED 503 from the center of the radiation fin 501 since the reflector surface 510A is formed into a mirror shape by combining a part of an oval shape.

Although in the first embodiment the low beam is composed of the reflection-type lamp array 50, the high beam 6 may be composed of the reflection-type lamp array 50.

Second Embodiment

Figure 6:
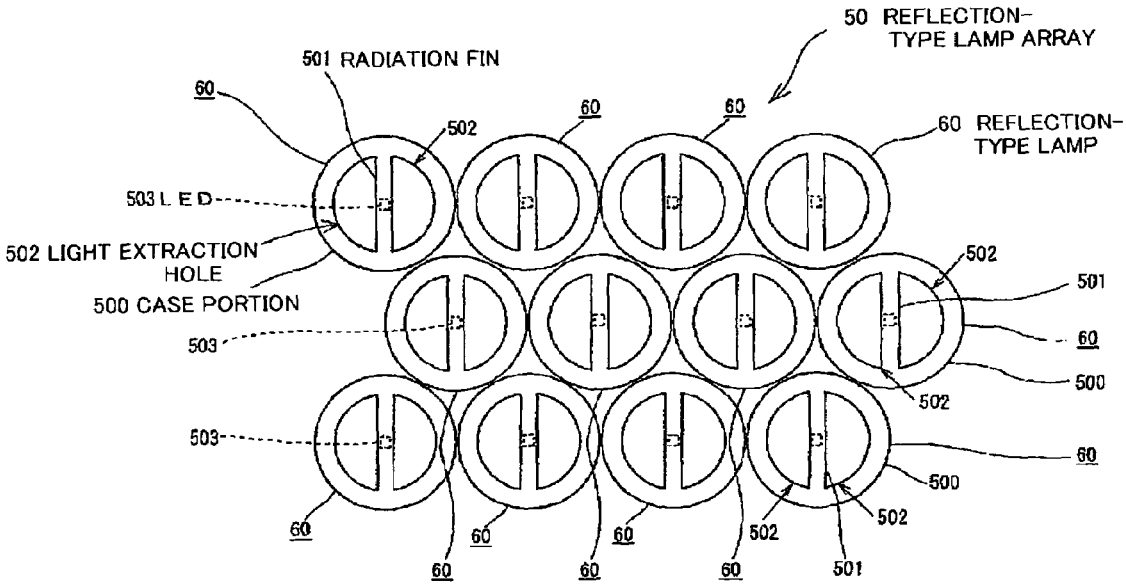
FIG. 6 is a front view showing a headlight in a second preferred embodiment according to the invention.
Figure 7:
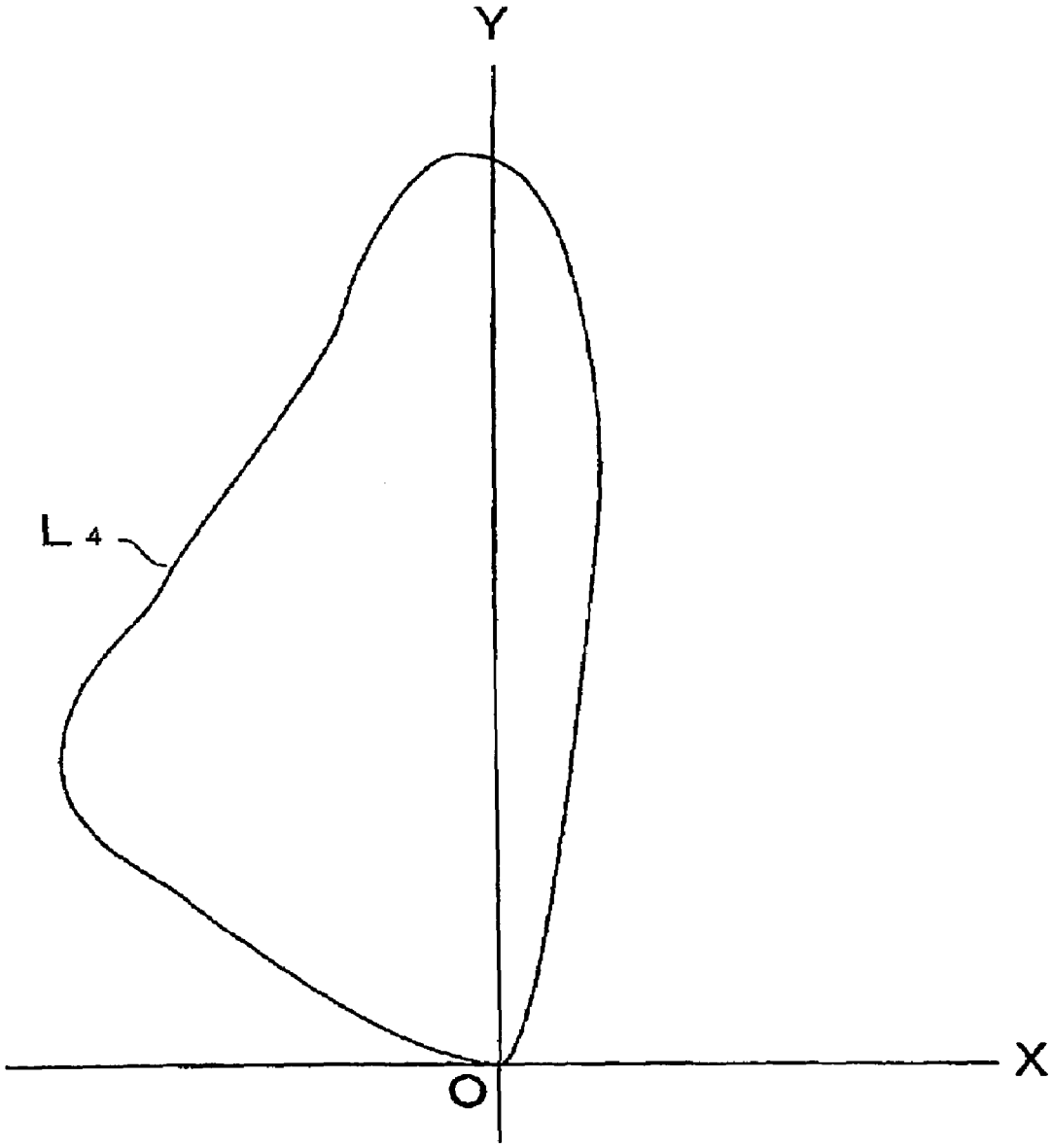
FIG. 7 is a diagram showing a light distribution of the headlight in the second embodiment.

FIG. 6 is a front view showing a headlight in the second preferred embodiment according to the invention. FIG. 7 is a diagram showing a light distribution of the headlight in the second embodiment. Hereinafter, like components are indicated by the same numerals as used in the first embodiment.

The low beam of the headlight portion 5 is composed of reflection-type lamps 60 which each have a small outer diameter equal to that of the short-range lamp 52 and medium-range lamp 53. The second embodiment is different from the first embodiment in that the reflection-type lamp 60 has an illuminating range from the short-range to the long-range, as shown by the light distribution property in FIG. 7. Meanwhile, the high beam is omitted in FIG. 7.

The reflection-type lamp 60 is composed such that three lamp rows each of which having four lamps disposed at equal intervals in the horizontal direction are zigzag arranged in upper, meddle and lower stages. The arrangement of the reflection-type lamp 60 can be arbitrarily changed in number of lamps, lamp rows or stages.

Effects of the Second Embodiment

In the second embodiment, adding to the effects of the first embodiment, the freedom of the lamp arrangement is increased so that the lamp arrangement can be selected according to the light distribution or the design of the car. Further, the headlight portion 5 can have a visually new design by arraying the plural reflection-type lamps 60 with the small outer diameter.

Third Embodiment

Figure 8:
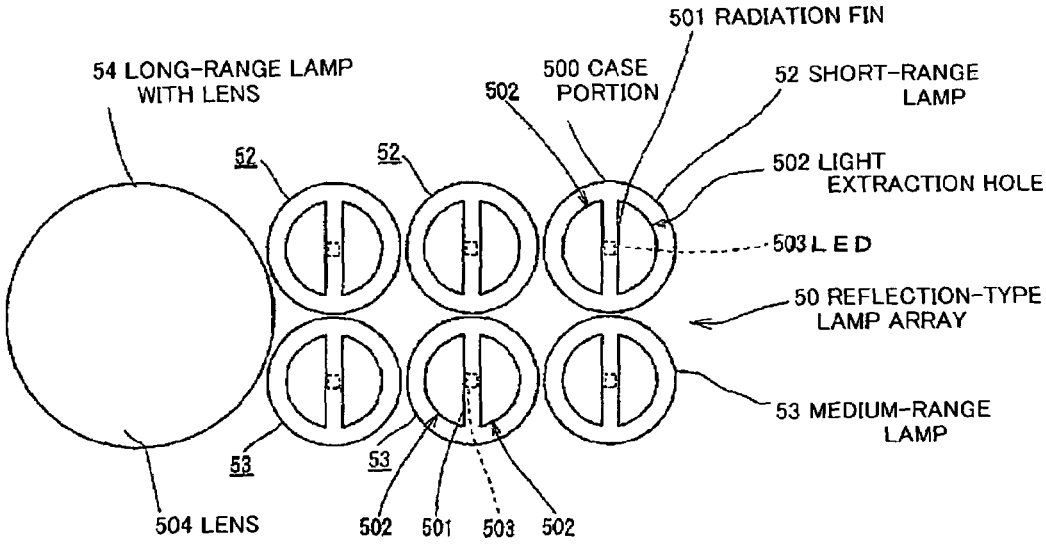
FIG. 8 is a front view showing a headlight in a third preferred embodiment according to the invention.
Figure 9:
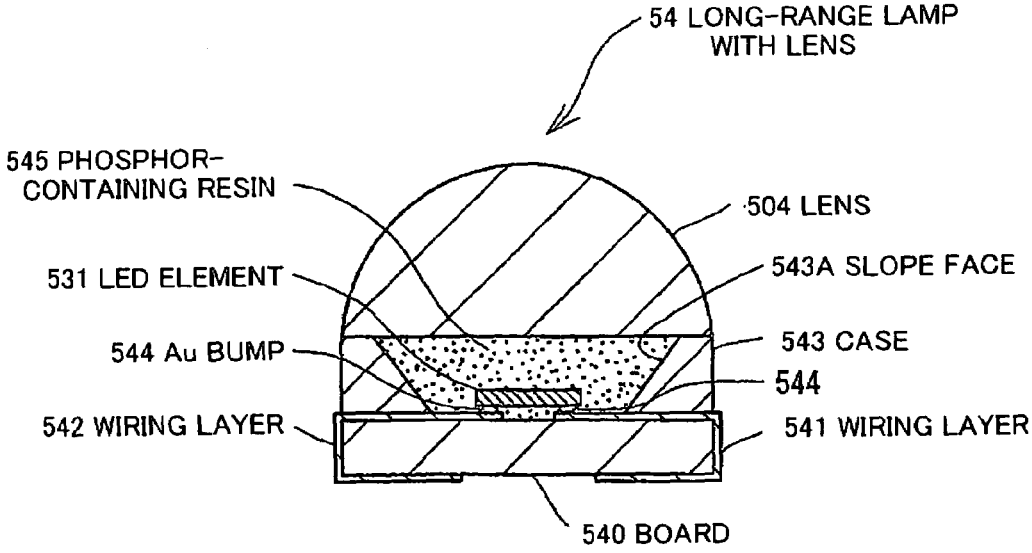
FIG. 9 is a cross sectional view showing a long-range lamp with a lens in the third embodiment.

FIG. 8 is a front view showing a headlight in the third preferred embodiment according to the invention. FIG. 9 is a cross sectional view showing a long-range lamp with a lens in the third embodiment.

The headlight portion 5 of the third embodiment is different from that of the first embodiment in that the low beam thereof is composed of a long-range lamp 54 with a high-intensity LED element 531 as well as a lens 504 as collector optics, instead of the long-range lamp 51 to compose the low beam as described in the first embodiment.

As shown in FIG. 9, the long-range lamp 54 with a lens comprises: a board 540 of ceramics; wiring layers 541, 542 which are formed on the surface of the board 540 to have a predetermined circuit pattern; a case 543 which is of ceramics and has a slope face 543A with an inner diameter increased in a direction from the element mount face to the light extraction side; an LED element 531 which is mounted on the board 540 through the wiring layers 541, 542 and an Au bump 544; a phosphor-containing silicone resin 545 which contains a YAG phosphor to be excited by blue light emitted from the LED element 531 to radiate yellow light and which seals the LED element 531; and the lens 504 which is integrated with the light extraction side of the case 543 and has a semisphere optical shape. In FIG. 9, the LED element 531 is a large-size element (1 mm square).

Effects of the Third Embodiment

In the third embodiment, the low beam is composed of the long-range lamp 54 with a lens which has the large-size element as a light source, and the short-range lamp 52 and the medium-range lamp 53 as a reflection-type lamp. Therefore, the headlight portion 5 can offer a high-brightness beam light based on the light-focusing property of the lens 504 in the long-range side as well as securing a good light-focusing property in the short-range and medium-range side.

Fourth Embodiment

Figure 10:
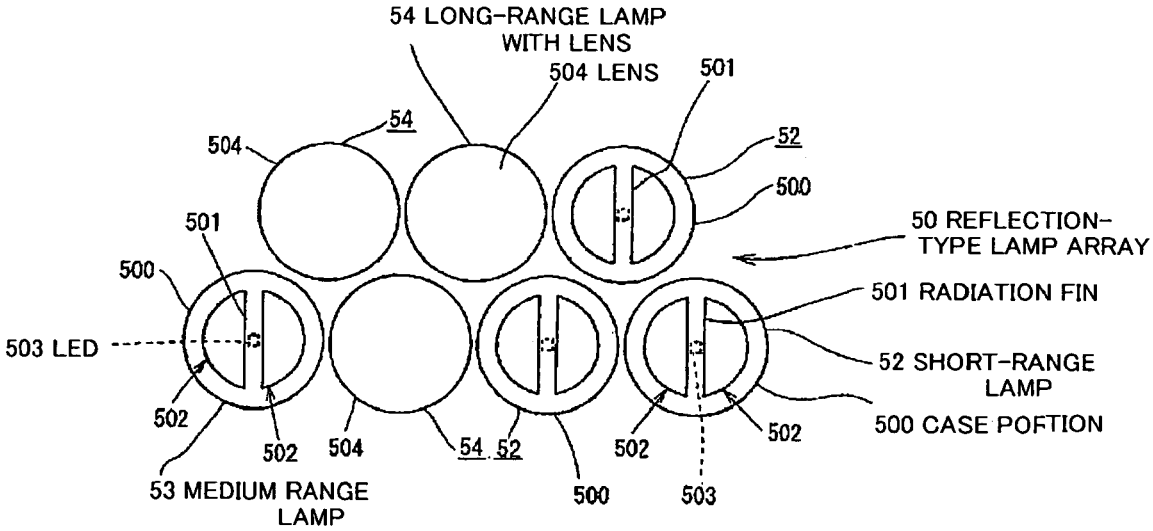
FIG. 10 is a front view showing a headlight in a fourth preferred embodiment according to the invention.

FIG. 10 is a front view showing a headlight in the fourth preferred embodiment according to the invention.

The headlight portion 5 of the fourth embodiment is different from that of the third embodiment in that the low beam thereof is composed of a long-range lamp 54 with a small diameter equal to that of the short-range lamp 52 and the medium-range lamp 53, instead of the long-range lamp 54 with the large diameter to compose the low beam as described in the third embodiment.

Effects of the Fourth Embodiment

In the fourth embodiment, adding to the effects of the third embodiment, the lamps are uniformed in size so that a good illumination property can be obtained in a wide rage and the entire headlight portion 5 can be downsized.

Fifth Embodiment

Figure 11A:
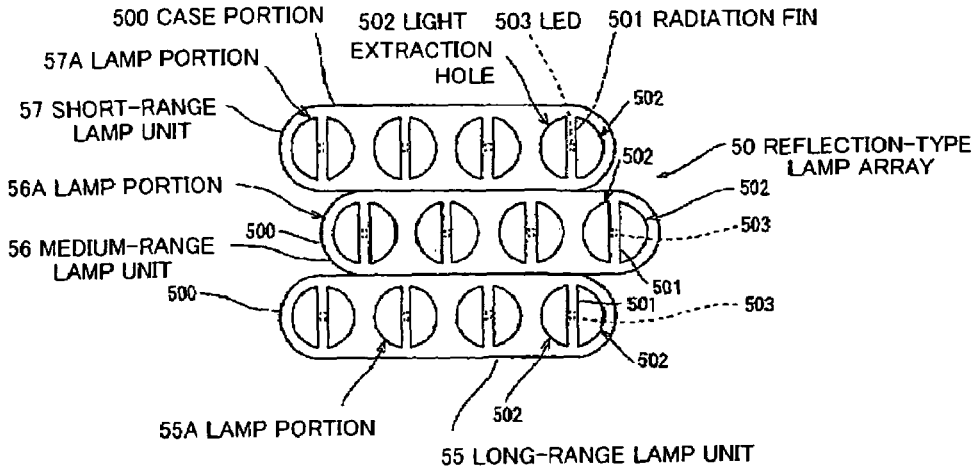
FIGS. 11A and 11B are front views showing reflection-type lamp arrays in a fifth preferred embodiment according to the invention, where
Figure 11B:
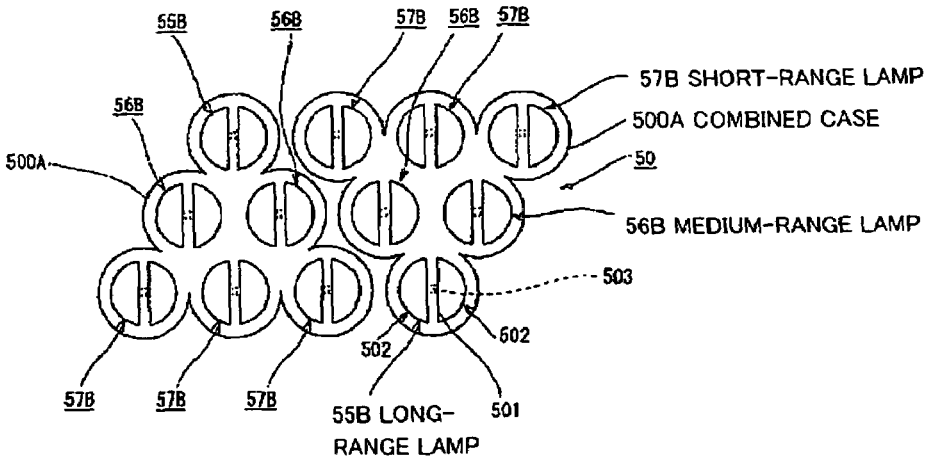

FIGS. 11A and 11B are front views showing reflection-type lamp arrays in the fifth preferred embodiment according to the invention, where FIG. 11A shows a reflection-type array with a lamp unit with a lamp portion arrayed linearly, and FIG. 11B shows a reflection-type array with a lamp unit with a lamp portion arrayed like a pyramid.

The headlight portion 5 of the fifth embodiment is different from that of the third embodiment in that the low beam thereof is, as shown in FIG. 11A, composed of three case portions 500 each comprising four lamp portions 55A, 56A or 57A comprising the radiation fin 501, the light extraction hole 502 and the LED 503, the four lamp portions 55A, 56A or 57A being arrayed at equal intervals and integrated with the laterally-long case portion 500 to compose a long-range lamp unit 55, a medium-range lamp unit 56 or a short-range lamp unit 57.

Effects of the Fifth Embodiment

In the fifth embodiment, adding to the effects of the second embodiment, the headlight portion 5 can be constructed without wasting time in arranging the lamps to enhance the mass productivity.

Alternatively, as shown in FIG. 11B, the case portion 500 may be formed like a pyramid (=a combined case 500A). One long-range lamp 55B, two medium-range lamps 56B and three short-range lamps 57B are integrated like a pyramid. This form allows the combined case 500A to have a surface area greater than the laterally-long case portion 500 to enhance the heat radiation property.

Sixth Embodiment

Figure 12A:
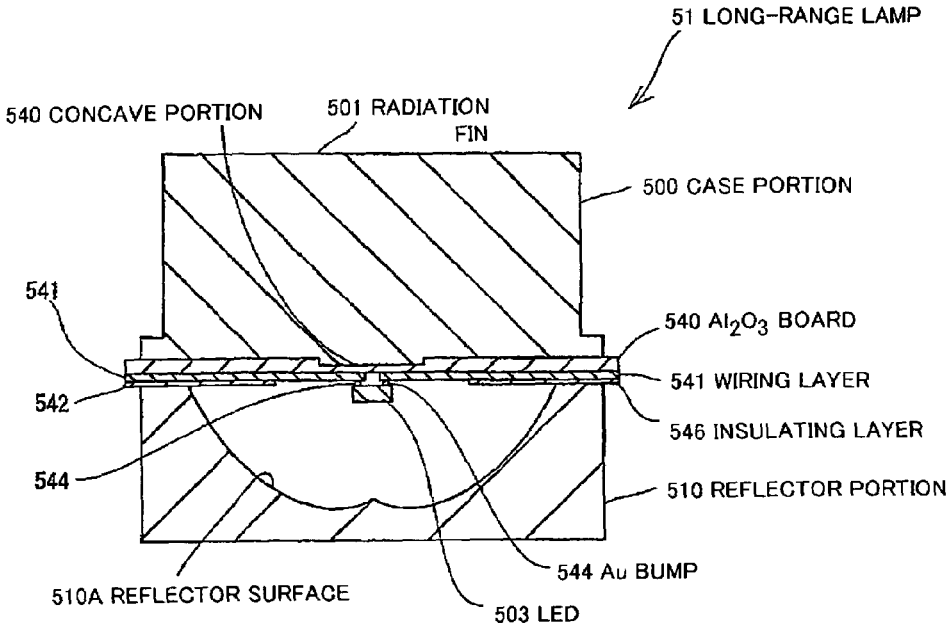
FIGS. 12A and 12B are cross sectional views showing low-beam long-range lamps in a sixth preferred embodiment according to the invention, where
Figure 12B:
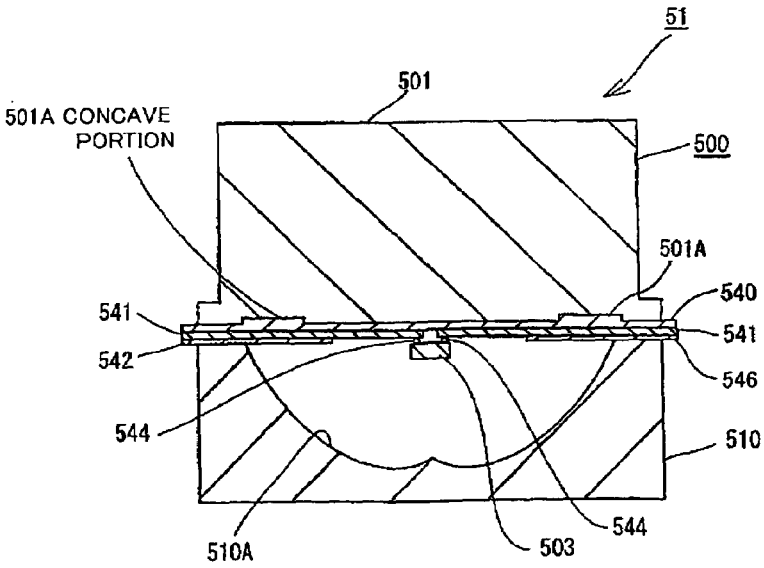

FIGS. 12A and 12B are cross sectional views showing low-beam long-range lamps in the sixth preferred embodiment according to the invention, where FIG. 12A shows a first board-positioning structure to a radiation fin, and FIG. 12B shows a second board-positioning structure to a radiation fin.

The long-range lamp 51 of the sixth embodiment is different from that of the first embodiment in that the LED 503 is bonded to the radiation fin 501 after being mounted on the $Al_2O_3$ board 540.

The $Al_2O_3$ board 540 is, as shown in FIG. 12A, composed of the wiring layer 541 with a circuit pattern formed of a copper foil on the mount surface, and an insulating layer 546 formed of a polyimide thin film to insulate the wiring layer 541 from the case portion 500 and the reflector portion 510. The LED 503 is electrically bonded through the Au bump 544 to the wiring layer 541. The $Al_2O_3$ board 540 is provided with a positioning concave portion 540A on the back of its mount region of the LED 503. The radiation fin 501 is provided with a convex portion corresponding to the concave portion 540A.

Effects of the Sixth Embodiment

In the sixth embodiment, the $Al_2O_3$ board 540 with the LED 503 mounted thereon can be easy positioned through the concave portion 540A to the radiation fin 501. Therefore, the mass productivity can be enhanced and the thickness of the substrate corresponding to the mount region of the LED 503 can be reduced to improve the heat conduction property to the radiation fin 501 to enhance the heat radiation property. Although the sixth embodiment is applied only to the long-range lamp 51, the same embodiment can be also applied to the short-range lamp 52 and the medium-range lamp 53.

Alternatively, as shown in FIG. 12B, two concave portions 501A can be formed on the radiation fin 501 and convex portions can be formed at the corresponding parts of the $Al_2O_3$ substrate 540. In this case, it is desired that the thickness of the substrate is determined in order not to reduce the heat conduction property from the mount region of the LED 503 to the radiation fin 501.

Further, the heat radiation property can be enhanced by reducing the thickness of the $Al_2O_3$ board 540 even when the concave portion 540A is not formed to keep the profile of the substrate flat. In this case, the step of making the concave portion on the radiation fin 501 corresponding to the concave portion 540A can be omitted to reduce the manufacturing cost.

Seventh Embodiment

Figure 13:
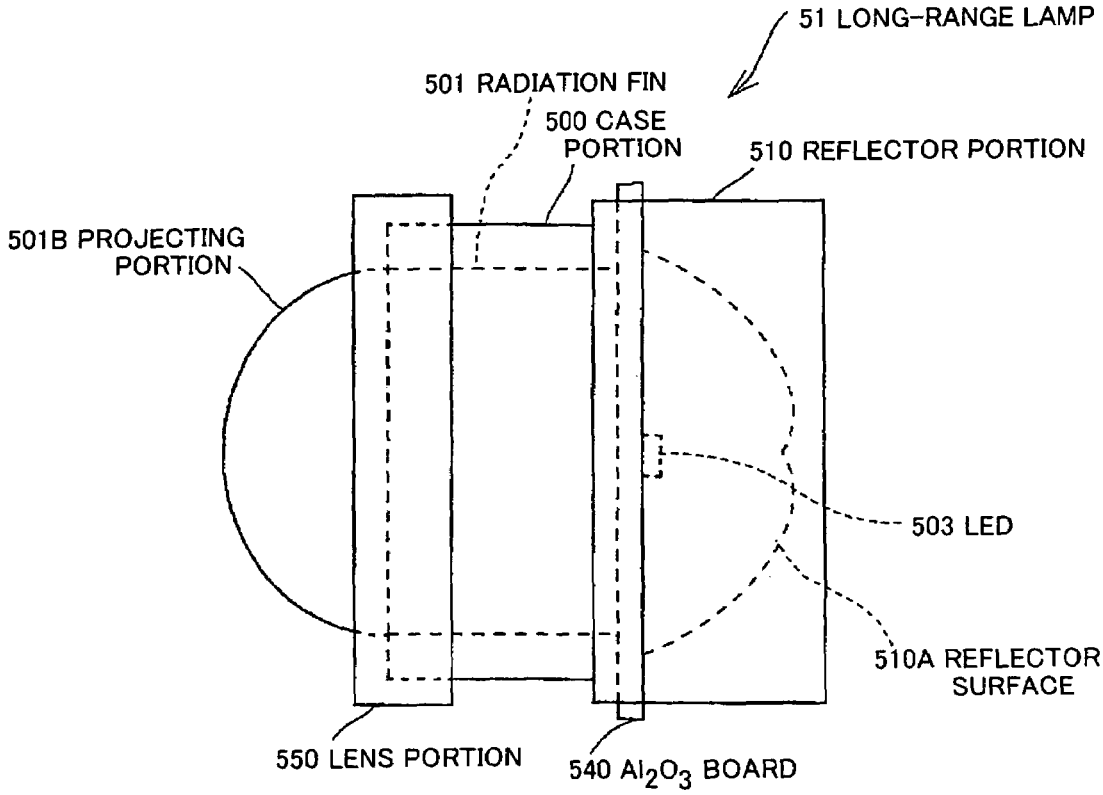
FIG. 13 is a side view showing a low-beam long-range lamp in a seventh preferred embodiment according to the invention.

FIG. 13 is a side view showing a low-beam long-range lamp in the seventh preferred embodiment according to the invention.

The seventh embodiment is different from the first embodiment in that the long-range lamp 51 is provided with a projecting portion 501B of the radiation fin 501 on the light extraction side of the case portion 500, and a lens portion 550 which can be detachably attached to seal the light extraction side of the case portion 500 while keeping the projecting portion 501B exposed.

Effects of the Seventh Embodiment

In the seventh embodiment, adding to the effects of the first embodiment, the surface area of the radiation fin 501 can be increased by providing the projecting portion 501B.

Further, the lens portion 550 provided to seal the light extraction side can prevent the penetration of a foreign material into the case portion 500 while increasing the surface area.

Further, since the lens portion 550 is detachably attached, the lens portion 550 with a different light-focusing property can be selected according to a desired light distribution property.

Although the seventh embodiment is applied only to the long-range lamp 51, the same embodiment can be also applied to the short-range lamp 52 and the medium-range lamp 53.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An LED lighting apparatus, comprising:

a plurality of reflection-type LED lamps, each of the plurality of reflection-type LED lamps comprising:

an LED;

a reflector portion to reflect a light emitted from the LED;

a case portion comprising a radiation fin that is formed along a vertical section of the case portion to pass through a center of the case portion; and a lead electrically connected to the LED to provide power to the LED, wherein the LED is mounted on an end of the radiation fin, and the lead is separated from the radiation fin, and wherein said plurality of reflective-type LED lamps have different light distribution properties to provide a different illuminating range, and wherein the case portion further comprises a lens portion that seals a part on a light extraction side of the case portion while keeping a part of the radiation fin exposed.

2. The LED lighting apparatus according to claim 1, wherein:

the LED comprises a glass-sealed LED, which includes an LED element and a phosphor sealed with a glass, wherein the phosphor is capable of being excited by the light emitted from the LED element.

3. The LED lighting apparatus according to claim 1, wherein:

the plurality of reflection-type LED lamps each comprises the case portion and the radiation fin which comprise a size corresponding to a predetermined illuminating range of each of the LED lamps.

4. The LED lighting apparatus according to claim 1, wherein:

the plurality of reflection-type LED lamps each comprises a reflector surface which comprises a size corresponding to a predetermined illuminating range of each of the LED lamps.

5. The LED lighting apparatus according to claim 4, wherein:

the reflector surface comprises a parabolic shape.

6. The LED lighting apparatus according to claim 1, wherein:

the plurality of reflection-type LED lamps each comprises a plurality of reflection-type LED lamps that comprise a same illuminating range and a same size.

7. The LED lighting apparatus according to claim 1, wherein:

at least one of the plurality of the reflection-type LED lamps is placed in the case portion.

8. The LED lighting apparatus according to claim 1, wherein:

the radiation fin comprises a positioning portion for positioning the LED at a predetermined position.

9. The LED lighting apparatus according to claim 1, further comprising:

a submount board attached to a surface of the radiation fin facing the reflector portion.

10. The LED lighting apparatus according to claim 9, wherein:

the radiation fin comprises a protrusion and the submount board is mounted on a surface of the protrusion.

11. The LED lighting apparatus according to claim 9, wherein:

the LED is electrically connected through the submount board to the lead.

12. The LED lighting apparatus according to claim 9, wherein:

the submount board comprises a circuit pattern electrically connected to the LED.

13. The LED lighting apparatus according to claim 9, wherein:

the submount board comprises an insulating material.

14. The LED lighting apparatus according to claim 9, wherein:

the submount board comprises a conductive layer disposed on a surface thereof, and the LED is electrically connected to the conductive layer through the submount board.

15. The LED lighting apparatus according to claim 1, wherein:

the reflector portion comprises a reflector surface formed on an inner surface of the reflector portion.

16. The LED lighting apparatus according to claim 15, wherein:

a portion of the reflector surface opposite the LED protrudes toward the LED.

17. The LED lighting apparatus according to claim 1, wherein:

the LED is sealed in a sealing material and the lead is disposed outside of the LED.

18. The LED lighting apparatus according to claim 1, wherein:

the case portion comprises a heat sink.

19. The LED lighting apparatus according to claim 1, wherein:

the plurality of reflection-type LED lamps comprises an array of short-range lamps, medium-range lamps, and long range lamps.

20. The LED lighting apparatus according to claim 1, wherein:

the lighting apparatus further comprises a submount board attached to a surface of the radiation fin.

* * * * *